US005746777A

United States Patent [19]

Fleckenstein et al.

[11] Patent Number: 5,746,777

[45] Date of Patent: May 5, 1998

[54] SCATTERABLE CARPET CLEANING FORMULATIONS

[75] Inventors: Theo Fleckenstein, Hilden; Alexander Ditze, Remscheid; Thomas Hahn, Hueckelhoven, all of Germany

[73] Assignee: Henkel Kommanditgesellschaft auf Aktien, Duesseldorf, Germany

[21] Appl. No.: 765,859

[22] PCT Filed: Jun. 13, 1995

[86] PCT No.: PCT/EP95/02288

§ 371 Date: Jan. 28, 1997

§ 102(e) Date: Jan. 28, 1997

[87] PCT Pub. No.: WO95/35358

PCT Pub. Date: Dec. 28, 1995

[30] Foreign Application Priority Data

Jun. 22, 1994 [DE] Germany ..... 44 21 784.6

[51] Int. Cl.[6] ..... C11D 3/00; C11D 7/44; C11D 3/382; D06L 1/00

[52] U.S. Cl. ..... 8/142; 8/137; 510/278; 510/462; 510/511; 252/184

[58] Field of Search ..... 8/142, 137; 510/278, 510/462, 511; 252/184

[56] References Cited

U.S. PATENT DOCUMENTS

| | | | |
|---|---|---|---|
| 3,622,427 | 11/1971 | Kelly | 277/227 |
| 3,630,919 | 12/1971 | Sheaffer et al. | 8/142 |
| 4,659,494 | 4/1987 | Soldanski et al. | 510/278 |
| 4,834,900 | 5/1989 | Soldanski et al. | 510/278 |
| 5,286,400 | 2/1994 | Paszek et al. | 510/278 |

FOREIGN PATENT DOCUMENTS

| | | |
|---|---|---|
| 178 566 | 4/1986 | European Pat. Off. . |
| 956 921 | 2/1950 | France . |
| 40 27 004 | 3/1992 | Germany . |
| WO 93/24588 | 12/1993 | WIPO . |

OTHER PUBLICATIONS

Derwent Abstract No. 86–234625 for JP 61–162, 600, Jul. 1986.

Kirk–Othmer Encyclopedia of Chemical Technology, 3rd ed., vol. 20, pp. 766–773 (month unknown), 1982.

*Primary Examiner*—Alan Diamond

*Attorney, Agent, or Firm*—Ernest G. Szoke; Wayne C. Jaeschke; Henry E. Millson, Jr.

[57] ABSTRACT

A scatterable dry cleaning formulation for textiles containing cellulose powder, colloidal silicon dioxide, and water.

18 Claims, No Drawings

SCATTERABLE CARPET CLEANING FORMULATIONS

This application is a 371 of PCT/EP95/02288 filed Jun. 6, 13, 1995.

BACKGROUND OF THE INVENTION

1. Field of the Invention This invention relates to a scatterable formulation for the dry cleaning of textiles, more especially carpets.

2. Statement of Related Art

In addition to shampoos, powder-form cleaning formulations have recently been increasingly used for cleaning carpets and other textile coverings in situ, enjoying the advantage that they do not leave any marks and dry more quickly. Cleaning powders of the type in question consist essentially of relatively large quantities of adsorbents and a cleaning liquid—generally consisting for the most part of water—adsorbed thereon. It is assumed that the cleaning liquid is responsible for separating the soil particles from the fibers and transporting them to the adsorbent which, after drying, is removed together with the soil either by brushing or by vacuum cleaning. Various materials have been proposed as adsorbents. Of these, it is only intended here to mention the cellulose powders described in European patent application 178 566 which have recently been acquiring particular significance. Although an extremely high standard in regard to cleaning performance and non-discoloration had been achieved with cleaning formulations based on cellulose powder, a search was nevertheless made for new compositions which would have an even higher cleaning performance with less resoiling and which would result in even less roughening of the carpet surface and in an even lower accumulation of residues of the cleaning formulation on the carpets in the event of repeated use.

According to U.S. Pat. No. 3,630,919, colloidal silica is added in small quantities to powder-form carpet cleaning formulations. Despite certain improvements achieved in this way, the cleaning formulations described in this U.S. patent are also unsatisfactory.

DESCRIPTION OF THE INVENTION

It has now surprisingly been found that scatterable carpet cleaning formulations containing both cellulose powder and colloidal silica are more effective in many respects than the hitherto known formulations.

Accordingly, the present invention relates to a scatterable dry cleaning formulation for textiles which contains cellulose powder, colloidal silicon dioxide and water. In addition, the formulation preferably contains small quantities of surfactant and/or rollable particles of a porous elastic material.

The new cleaning formulation has an extremely high cleaning performance and is distinguished by an only very slight tendency of the correspondingly cleaned textiles towards resoiling. In addition, the tendency to accumulate residues in the event of repeated application to the same textile material is distinctly lower by comparison with conventional formulations. However, the unusually gentle effect on the textile materials during cleaning is particularly surprising. In general, scatterable carpet cleaning formulations only achieve a good cleaning effect when, after scattering onto the carpet, they are worked in by either manual or machine brushing so that they come into contact with all soil-carrying fibers. The brushing-in of the cleaning powder imposes particular demands on the strength of the carpet fibers on account of the forces involved. Roughening of the surface and losses of carpet fibers often cannot be avoided and, in the event of repeated application, can result in visible damage to the textile material. This damage to the textile material which all conventional formulations cause to a more or less considerable extent occurs to a far lesser extent where the formulations according to the invention are used.

The cellulose powders suitable for use in accordance with the invention are produced from commercial cellulose, which is generally obtained from parts of plants, more especially from wood, by size reduction using mechanical and/or chemical processes. Corresponding powders, which are colorless and substantially free from lignin and other impurities emanating from the plant material, are commercially available in various degrees of fineness. The finer qualities with an average fiber length of 50 to 400 micrometers are preferred for the purposes of the present invention. In these qualities, the average fiber thickness is between 10 and 50 micrometers. The particle size of the cellulose powder may also be determined by screening techniques, for example by air jet screening in accordance with DIN 53734. Accordingly, cellulose powders with the following particle size distribution (as determined by the above-mentioned method) are also preferred:

under 32 μm: 40±7% by weight
between 32 and 71 μm: 35±5% by weight
between 71 and 200 μm: 24±4% by weight
over 200 μm: max. 1% by weight
under 200 μm: at least 99% by weight.

Cellulose powders produced from wood cellulose, more particularly from hardwood cellulose, are preferably used in the formulations according to the invention. A particularly preferred cellulose is beechwood cellulose. Of these powders, those qualities which can readily be obtained solely by mechanical methods, for example by grinding, are particularly preferred. The percentage content of cellulose powder in the formulation according to the invention is preferably from 36 to 55% by weight and more preferably from 39 to 52% by weight, based on the final formulation.

The formulations according to the invention contain colloidal silicon dioxide, also known as colloidal silica, as a second key active ingredient. This material is commercially available as a colloidal aqueous solution with various concentrations, the silica particles generally being stabilized in the solution by cationic or anionic surface charges. For stabilization, the solutions may contain other inorganic materials, more especially alkali and soluble salts. Examples of suitable commercial products are Ludox® and Syton®, both products of DuPont, and Levasil®, a product of Bayer AG. The solutions contain the silica in the form of generally spherical individual particles which are hydroxylated at their surface and of which the size in the majority of cases is between about 7 and about 50 nanometers. If the colloidal silica solutions dry on their own, solids with specific surfaces (BET method) of 100 to 300 $m^2/g$ are obtained according to particle size. To produce the formulations according to the invention, however, the colloidal silicas are added to the cellulose powder and to the other constituents, preferably in the form of a colloidal solution. Colloidal silicas of which the individual particles are stabilized by anionic surface charges and which contain sodium ions in particular as counterions are particularly preferred. The quantity of colloidally dissolved silicon dioxide in the formulations according to the invention is preferably from 0.1 to 10% by weight and more preferably from 1.5 to 5% by weight, expressed as water-free active substance and based on the formulations according to the invention as a whole.

In addition to cellulose powder and colloidal silicon dioxide, the formulations according to the invention may also contain other powder-form adsorbents known per se for dry cleaning formulations should this be desirable for obtaining special additional effects. Examples of such adsorbents are bentonite, kieselguhr, zeolite, starch and powdered foam plastics, for example ground polyurethane foam. Ground foam glass (perlite) has proved successful as an additional adsorbent and also acts as a bulking agent. The quantity in which these additional adsorbents are used is always selected so that the properties of the formulations are not adversely affected. Accordingly, their content in the formulations according to the invention is always below the content of cellulose powder, preferably amounting to less than 50% by weight and, more preferably, to less than 30% by weight, based on the content of cellulose powder.

In the most simple case, the formulations according to the invention contain water as sole impregnating liquid in addition to the adsorbents mentioned above. The quantity in which this liquid is used is gauged in such a way that it is still taken up by the solid constituents of the formulation, i.e. in particular by the cellulose powder, thus guaranteeing the scatterability of the formulation. The water content consisting of the water added during production and the water already present in the raw materials is preferably from 35 to 70% by weight and more preferably from 40 to 60% by weight.

However, if appropriate for special reasons, the impregnating liquid may contain other auxiliaries and additives which are advantageous, for example, for increasing the cleaning effect or for preserving the final formulation. For example, the liquid may contain organic solvents. Suitable organic solvents are both water-miscible and water-immiscible solvents providing they do not attack the textiles and are sufficiently volatile to evaporate in the required time after application of the formulation to the textile. In addition, it is important when selecting the solvent to bear in mind that it should have a sufficiently high flashpoint in the final product mixture and should be toxicologically safe. Suitable solvents are alcohols, ketones, glycol ethers and hydrocarbons, for example isopropanol, acetone, ethers of monoethylene and diethylene glycol and mono-, di- and tripropylene glycol with boiling points of at least 120° C., and gasolines with boiling points of 130° to 200° C. and also mixtures of these solvents. Monoalcohols containing 2 to 3 carbon atoms and mixtures thereof are preferably used. The percentage content of organic solvent is normally not more than 20% by weight and, more particularly, is from 2 to 10% by weight, based on the cleaning formulation as a whole.

In addition, the formulations according to the invention may contain surfactants as cleaning-active additives, the surfactants emanating from the classes of anionic and nonionic surfactants. Although excellent surface cleaning is achieved without the addition of a surfactant, the removal of greasy stains can be further improved by the addition of surfactants. In general, a surfactant addition of up to 10% by weight is sufficient. The formulations preferably contain 0.05 to 5% by weight and, more preferably, 0.1 to 3% by weight, based on the total weight of the formulation, of surfactants. Of the large number of known surfactants, those substances which, together with the adsorbents and other non-volatile constituents, if any, present in the formulations, dry off to leave a solid brittle residue are particularly suitable.

Suitable nonionic surfactants for the formulations according to the invention are, in particular, adducts of 1 to 30 moles and preferably 4 to 15 moles of ethylene oxide or mixtures of ethylene oxide and propylene oxide with 1 mole of a compound containing 10 to 20 carbon atoms from the group of alcohols, alkylphenols, carboxylic acids and carboxylic acid amides. The condensation products of reducing sugars and long-chain alcohols known as alkyl glycosides are also eminently suitable. The adducts of ethylene oxide with long-chain primary or secondary alcohols, for example fatty alcohols or oxoalcohols, and the alkyl polyglucosides containing 1 to 3 glucose units per molecule and 8 to 18 carbon atoms in the alkyl group synthesized from glucose and fatty alcohols are particularly preferred.

Suitable anionic surfactants are, in particular, those of the sulfate or sulfonate type, although other types, such as soaps, long-chain N-acyl sarcosinates, salts of long-chain sulfosuccinic acid esters or salts of ether carboxylic acids obtainable from long-chain alkyl or alkylphenyl polyglycol ethers and chloroacetic acid, may also be used. The anionic surfactants are preferably used in the form of the sodium salts, although the lithium salts may also afford advantages.

Particularly suitable surfactants of the sulfate type are the sulfuric acid monoesters of long-chain primary alcohols of natural and synthetic origin containing 10 to 20 carbon atoms, i.e. fatty alcohols such as, for example, cocofatty alcohols, tallow fatty alcohols, oleyl alcohol or the $C_{10-20}$ oxoalcohols, and sulfuric acid monoesters of secondary alcohols with the same chain lengths. In addition, sulfuric acid monoesters of aliphatic primary alcohols, secondary alcohols or alkylphenols ethoxylated with 1 to 6 moles of ethylene oxide are also suitable. These surfactants are also known as ether sulfates. Sulfated fatty acid alkanolamides and sulfated fatty acid monoglycerides may also be used.

The surfactants of the sulfonate type are, primarily, sulfosuccinic acid monoesters and diesters containing 6 to 22 carbon atoms in the alcohol components, alkyl benzene sulfonates containing $C_{9-5}$ alkyl groups and esters of α-sulfofatty acids, for example the α-sulfonated methyl or ethyl esters of hydrogenated coconut oil, palm kernel oil or tallow fatty acids. Other suitable surfactants of the sulfonate type are the alkane sulfonates obtainable from $C_{12-18}$ alkanes by sulfochlorination or sulfoxidation and subsequent hydrolysis or neutralization or by bisulfite addition onto olefins and the olefin sulfonates, i.e. mixtures of alkene and hydroxyalkane sulfonates and also disulfonates obtained, for example, from long-chain monoolefins with a terminal or internal double bond by sulfonation with gaseous sulfur trioxide and subsequent alkaline or acidic hydrolysis of the sulfonation products.

Particularly preferred surfactants are the olefin sulfonates which are preferably used in quantities of 0.1 to 1% by weight in the formulations and the fatty alcohol sulfates and fatty alcohol ether sulfates which are preferably used in quantities of 0.1 to 5% by weight.

In addition to the components already mentioned, the formulations according to the present invention may also contain small quantities of other auxiliaries and additives typically encountered in textile and carpet cleaning compositions. Examples of such auxiliaries and additives are antistatic components, optical brighteners, redeposition inhibitors, additives which improve scatterability and dispersibility, preservatives and perfume. Above all in cases where dust-emitting components are to be incorporated in the formulations, it is advisable to add small quantities of waxes or oils to bind any dust. These auxiliaries and additives are normally used in total quantities of not more than 5% by weight and preferably in quantities of not more than 2% by weight, based on the formulation as a whole.

Relatively large rollable particles of a porous elastic material, more particularly of a sponge material, may be regarded as a particularly preferred auxiliary for the cleaning formulations according to the invention. These particles have a maximum length of about 1 to 50 mm and preferably of about 1 to 10 mm, their dimensions in the other two spatial directions which are perpendicular to one another and to this length making up at least 10% and, more particularly, at least 20% of this maximum length. These rollable particles may be regular or irregular in shape. A key requirement is that their shape should be such that the particles are able to roll under the brush swept over the carpet during incorporation of the carpet cleaning formulation. Accordingly, the particles may be spherical, cylindrical, ellipsoidal or ovoidal in shape although they may also assume irregular shapes as formed, for example, by agglomeration of relatively small particles into granules. However, where highly elastic and readily deformable materials in particular are used, more angular particles up to and including cubes and squares are also rollable and are suitable for the formulations according to the invention.

The rollable particles may consist of various materials. However, rollable particles consisting predominantly or completely of viscose, natural sponge or open-cell plastic foam are particularly preferred. The rollable particles are preferably produced from relatively large pieces of material which are reduced to the required size by cutting up or grinding. Foamed material, nonwovens or woven fabrics are preferably used as the starting material. In one particularly preferred embodiment, the rollable particles consist of viscose sponge flakes.

During the cleaning process, the rollable particles combine with fluff and fibers which have accumulated on the carpets and may then be readily removed with them from the surface of the carpet. The content of rollable particles in the formulations according to the invention can be relatively small because even a few particles are sufficient to obtain the required effect. Thus, the percentage content of rollable particles in the formulations is preferably about 0.1 to 10% by weight and more preferably 0.1 to 1% by weight, based on the formulation as a whole.

The production of the formulations does not involve any problems so that simple, generally single-stage processes may be applied. The production process is normally carried out using simple mixers, such as blade or drum mixers, in which cellulose powder and any other solid components are initially introduced and then sprayed in motion with the liquids in which other components may optionally be dissolved. Depending upon the mechanics and composition involved, the formulations can thus be produced in a very fine-particle form or even in more or less agglomerated form, although the composition always ensures that even the agglomerated forms readily disintegrate on the textiles without any need for significant mechanical work. Through the choice of flake-like agglomerates, the flow properties of the formulation can be reduced to the extent of extremely slow-flowing products which are preferred for certain applications.

The apparent density of the formulations may also be influenced to a certain extent in the production process by the choice of more or less compact agglomerates. Thus, the formulations normally have apparent densities of 200 to 350 g/l, with the result that comparatively large volumes are applied per unit area. This provides in particular for uniform distribution, particularly when the formulations are scattered onto carpets by hand.

The textiles and carpets are cleaned by scattering the cleaning formulation according to the invention onto the textiles either by hand or by means of a suitable distributor and then rubbing the formulation more or less intensively into the textiles, for example by means of a sponge or a brush. In general, the working-in times are between 0.5 and 2.5 minutes and preferably between 0.5 and 1.5 minutes per square meter. After the formulation has been rubbed in, the textiles are left to dry off until the cleaning formulation, which combines with the soil, has changed into dry residues. These residues are then removed from the textiles mechanically, for example by brushing or vacuum cleaning. For the surface cleaning of textiles, the formulation according to the invention is applied in quantities of 2 to 150 g/m$^2$, depending on the fullness of the textiles and the degree of soiling, although larger quantities may also be locally applied to remove individual stains. For cleaning carpets, the formulation is normally applied in quantities of 10 to 100 g/m$^2$. The process as a whole may largely be carried out manually, for example in the home, although it is also possible to carry out the rubbing in of the formulation and, optionally, other steps by means of suitable machines, for example combined distributing and brushing machines, so that the process is equally suitable for use in the institutional sector.

EXAMPLES

The cleaning formulations described in the following Examples were produced as follows:

Cellulose powder, polyurethane flour and, optionally, viscose flakes were introduced into and premixed in a blade mixer. The water-based cleaning liquid was separately prepared from the other components without the colloidal silica in a mixing vessel. The liquid was then sprayed onto the absorbent in motion in the blade mixer before the silica solution was sprayed on. Slightly moist but free-flowing products were formed in every case.

Arbocel®B 800 X, a product of J. Rettenmaier & S öhne, was used as the cellulose powder in the following Examples. According to the manufacturer, this cellulose powder has an average fiber length of 200 μm for an average fiber thickness of 20 μm and the following particle size distribution (as determined by air jet screening):

under 32 μm: 40% by weight
under 71 μm: 75% by weight
under 200 μm: 99.5% by weight.

The colloidal silica used in the Examples was Ludox HS 40®, a product of Du Pont. This is a colloidal aqueous solution containing 40% by weight $SiO_2$ in which the silica particles are negatively charged and stabilized with sodium ions.

The viscose flakes used are a product of Beli-Chemie GmbH and are marketed for use as absorbing flakes for taking up spilt liquids. The material has an apparent density of around 90 g/l.

Cleaning performance was tested on pieces of carpeting which had been artificially soiled. The carpet material used was a light grey polyamide uncut-pile carpet which had been cut into pieces measuring 122.5×79 cm and which was placed in a laboratory soiling drum containing 1500 g of steel balls and soiled for 30 minutes with 15 g of a test soil from the Wäschereiforschungsanstalt Krefeld (of which 85% by weight consisted of the sieved contents of a vacuum cleaner bag and 15% by weight of a standard mixture of kaolin, silica flour, iron oxide and soot). For the further tests, the piece of carpet was cut up into three equal pieces approximately 40 cm wide.

The cleaning tests were carried out on areas of around 0.25 $m^2$ of the soiled pieces of carpet by uniformly scattering 25 g of cleaning powder onto the surface and then working it in by brushing. The brush used was a medium-hard brush with polypropylene bristles with which the surface was uniformly brushed for about 25 seconds with vigorous strokes from various directions. After drying, which took about 4 hours, the pieces of carpet were thoroughly vacuum-cleaned until no visible powder residues remained on the carpet. The results obtained were evaluated using a Dr. Lange Micro Color color difference measuring instrument on the basis of the CIELAB method (DIN 6074). The three-dimensional color representation in the form of the L*, a* and b* diagram is used, the lightness (L*)—also known as the grey value—being situated on the vertical axis of the three-dimensional color body. The value $L^*_0=0$ is equated with black; the value $L^*_{100}=100$ is the lightness of the white standard where the untreated carpet was placed in the measurements carried out here. In the following Tables, the cleaning results of the individual formulations are expressed as the number of units by which the value L* was found to be lighter or darker than in the case of cleaning with the formulation A used as standard.

Resoiling behavior was tested by initially subjecting pieces of carpet measuring 40×79 cm, which consisted of the same material as described above, to the cleaning process described above and then treating them with the test soil in the manner described above. The results were visually evaluated by comparison with pieces of carpet which had been treated with the standard cleaning formulation. The following evaluation scale was used:

++=greatly increased resoiling compared with the standard formulation

+=increased resoiling compared with the standard formulation

+−=same resoiling as the standard formulation

−=reduced resoiling compared with the standard formulation.

To measure fiber stress during incorporation of the cleaning powder, a carpet brush with stiff polypropylene bristles was drawn under standardized conditions across a needleloom carpet over which cleaning powder had been uniformly scattered. In these tests, too, the cleaning powder was used in a quantity of 100 g per $m^2$. The tractive force required for the uniform movement of the brush was measured with a spring balance and is shown in grams in Table 1. The lower this force, the less the carpet fibers are stressed during cleaning.

The composition of the individual formulations used for the tests is shown in % by weight in Tables 1 to 3 below, the figures relating to active substance. The results reflect the outstanding effectiveness of formulations 1 to 15 according to the invention.

TABLE 1

| | Examples | | | | | | |
|---|---|---|---|---|---|---|---|
| | A | B | 1 | 2 | 3 | 4 | 5 |
| Celluose powder | 43.0 | 50.0 | 52.0 | 43.0 | 43.0 | 43.0 | 46.0 |
| Colloidal $SiO_2$ | | | 1.60 | 2.40 | 2.40 | 3.20 | 3.20 |
| $C_{12/18}$ fatty alcohol sulfate, sodium (Texapon ® K12) | | 6.00 | 1.00 | 1.00 | 3.00 | 1.00 | 2.00 |
| Olefin sulfonate, Na (Hostapur ® OS) | 0.80 | | | | | | |
| Ethanol | | | 2.00 | 7.00 | 7.00 | 7.00 | 4.00 |
| Low-aromatic gasoline (Isopar ® M) | 1.50 | | | | | | |
| Viscose flakes | | 0.25 | 0.25 | 0.25 | 0.25 | 0.25 | 0.25 |
| Water, perfume, preservative | 54.7 | 43.75 | 43.15 | 46.35 | 44.35 | 45.55 | 44.55 |
| Cleaning, L | 0 | −1.3 | 0.4 | 1.4 | 0.5 | 2.0 | 1.1 |
| Resoiling | +− | + | +− | +− | +− | − | − |
| Tractive force in g | 120 | 118 | 105 | 118 | 109 | 110 | 111 |

TABLE 2

| | Examples | | | | | |
|---|---|---|---|---|---|---|
| | 6 | 7 | 8 | 9 | 10 | 11 |
| Celluose powder | 43.0 | 43.0 | 43.0 | 43.00 | 44.00 | 43.00 |
| Colloidal $SiO_2$ | 3.2 | 3.2 | 3.20 | 4.00 | 4.00 | 4.80 |
| $C_{12/18}$ fatty alcohol sulfate, sodium (Texapon ® K12) | | 1.00 | 1.00 | 1.00 | 3.00 | 1.00 |
| Olefin sulfonate, Na (Hostapur ® OS) | | | | | | |
| Ethanol | | | | | | |
| Low-aromatic gasoline (Isopar ® M) | | | | | | |
| Viscose flakes | 0.25 | | 0.25 | 0.25 | 0.25 | 0.25 |
| Water, perfume, preservative | 53.55 | 52.80 | 52.55 | 51.75 | 48.75 | 50.95 |
| Cleaning, L | 0.8 | 1.6 | 2.0 | 4.0 | 4.2 | 2.5 |
| Resoiling | +− | +− | − | − | +− | − |
| Tractive force in g | 111 | 120 | 110 | 110 | 110 | 109 |

TABLE 3

| | Examples | | | |
|---|---|---|---|---|
| | 12 | 13 | 14 | 15 |
| Celluose powder | 43.0 | 43.00 | 43.00 | 46.0 |
| Colloidal $SiO_2$ | 3.20 | 4.00 | 4.00 | 1.60 |
| $C_{12/18}$ fatty alcohol sulfate, sodium (Texapon ® K12) | 3.00 | 1.00 | 3.00 | |
| Olefin sulfonate, Na (Hostapur ® OS) | | | | |
| Ethanol | 7.00 | 7.00 | 7.00 | |
| Low-aromatic gasoline (Isopar ® M) | | | | |
| Viscose flakes | 0.25 | 0.25 | 0.25 | 0.25 |
| Water, perfume, preservative | 43.55 | 44.75 | 42.75 | 52.15 |
| Cleaning, L | 4.2 | 2.6 | 1.6 | 1.2 |
| Resoiling | + | − | + | + |
| Tractive force in g | 108 | 112 | 111 | 110 |

We claim:

1. A scatterable dry cleaning formulation for textiles comprising:

A) cellulose powder which is substantially free from lignin and other impurities from plant material;

B) colloidal silicon dioxide in the form of a dilute aqueous preparation with a negative particle charge and charge compensation by sodium ions; and C) water.

2. The dry cleaning formulation of claim 1 wherein component A is present in from 36 to 55% by weight; and component B is present in from 0.1 to 10% by weight based on the weight of silicon dioxide.

3. The dry cleaning formulation of claim 2 wherein component A is present in from 39 to 52% by weight and component B is present in from 1.5 to 5% by weight.

4. The dry cleaning formulation of claim 1 wherein component A is derived from hardwood cellulose.

5. The dry cleaning formulation of claim 4 wherein the hardwood cellulose is beechwood cellulose.

6. The dry cleaning formulation of claim 1 wherein the formulation also comprises at least one surfactant.

7. The dry cleaning formulation of claim 6 wherein the at least one surfactant is at least one anionic surfactant.

8. The dry cleaning formulation of claim 5 wherein the at least one anionic surfactant is selected from the group consisting of alcohol sulfates, ether sulfates, sulfonate surfactants, soaps, long chain N-acyl sarcosinates, salts of long-chain sulfosuccinic acid esters, and salts of ether carboxylic acids.

9. The dry cleaning formulation of claim 6 wherein the at least one surfactant is present in from 0.05 to 10% by weight.

10. The dry cleaning formulation of claim 9 wherein the at least one surfactant is present in from 0.1 to 3% by weight.

11. The dry cleaning formulation of claim 6 wherein the at least one surfactant is at least one nonionic surfactant.

12. The dry cleaning formulation of claim 6 which also comprises rollable particles of an elastic porous material.

13. The dry cleaning formulation of claim 1 which also comprises rollable particles of an elastic porous material.

14. The dry cleaning formulation of claim 13 wherein said particles are present in from 0.1 to 10% by weight.

15. The dry cleaning formulation of claim 14 wherein said particles are present in from 0.1 to 1% by weight.

16. The dry cleaning formulation of claim 13 wherein the elastic porous material is sponge flakes.

17. A process for cleaning a textile comprising the steps of

I) scattering the dry cleaning formulation of claim 1 onto the textile to be cleaned in a quantity of from 2 to 150 $g/m^2$;

II) rubbing the dry cleaning formulation into the textile;

III) drying or allowing the textile to dry; and

IV) mechanically removing the dried residue from the formulation from the textile.

18. The process of claim 17 wherein the textile is a carpet and step IV is carried out by vacuuming.

* * * * *